US007430819B2

(12) United States Patent
Auger et al.

(10) Patent No.: US 7,430,819 B2
(45) Date of Patent: Oct. 7, 2008

(54) ARTICLE OF FOOTWEAR WITH HEIGHT ADJUSTABLE CLEAT-MEMBER

(75) Inventors: Perry W. Auger, Tigard, OR (US); Kevin Fallon, Portland, OR (US)

(73) Assignee: Nike, Inc., Beaverton, OR (US)

( * ) Notice: Subject to any disclaimer, the term of this patent is extended or adjusted under 35 U.S.C. 154(b) by 152 days.

(21) Appl. No.: 11/018,814

(22) Filed: Dec. 22, 2004

(65) Prior Publication Data

US 2006/0130372 A1 Jun. 22, 2006

(51) Int. Cl.
*A43B 5/00* (2006.01)
*A43C 15/00* (2006.01)

(52) U.S. Cl. ..... 36/134; 36/67 R; 36/61

(58) Field of Classification Search ..... 36/134, 36/61, 67 R, 67 D, 100, 101, 81
See application file for complete search history.

(56) References Cited

U.S. PATENT DOCUMENTS

| | | | | | |
|---|---|---|---|---|---|
| 19,205 | A | | 1/1858 | Pollard | |
| 691,857 | A | | 1/1902 | Hansen | |
| 1,361,078 | A | | 12/1920 | Lynn | |
| 1,487,976 | A | * | 3/1924 | Rossi et al. | 36/61 |
| 1,662,111 | A | | 3/1928 | Halstead | |
| 2,002,556 | A | | 5/1935 | Tubbs | |
| 2,383,267 | A | * | 8/1945 | Malmqvist | 36/66 |
| 2,934,840 | A | | 5/1960 | Mistarz | |
| 3,267,593 | A | * | 8/1966 | Turner | 36/59 R |
| 3,442,033 | A | | 5/1969 | Hilburn, Jr. | |
| 3,496,656 | A | * | 2/1970 | Caine | 36/67 A |
| 3,526,976 | A | | 9/1970 | Jacobs | |
| 3,566,489 | A | | 3/1971 | Morley | |
| 3,715,817 | A | | 2/1973 | White et al. | |
| 3,731,406 | A | * | 5/1973 | Young | 36/67 D |
| 3,738,026 | A | | 6/1973 | Granger | |
| 3,805,418 | A | * | 4/1974 | Matuka et al. | 36/34 A |
| 3,898,751 | A | | 8/1975 | Gustin | |
| 3,911,600 | A | | 10/1975 | Dassler | |
| 4,159,582 | A | * | 7/1979 | Ostrowski | 36/67 D |
| 4,306,360 | A | | 12/1981 | Hagger | |
| 4,318,232 | A | | 3/1982 | Ching | |

(Continued)

FOREIGN PATENT DOCUMENTS

| | | |
|---|---|---|
| CA | 873080 | 6/1971 |

(Continued)

*Primary Examiner*—Marie Patterson
(74) *Attorney, Agent, or Firm*—Banner & Witcoff, Ltd.

(57) ABSTRACT

An article of footwear has selectively height adjustable cleat members provided on a sole. A cleat member provided in a unit engaged with or otherwise attached to the sole. The cleat member may have a portion which extends outwardly from the sole that is positionable at one of a plurality of predetermined positions relative to the sole and includes a biasing to at least one of the predetermined positions. A cleat may include a coupling engaged with the sole and a tip that is selectively extendable and retractable via a linear movement and rotational movement relative to a remainder of a cleat so as to present a selectively variable height. The sole may include a plurality of cleats in which the cleats include a gyre-linear cleat portion adjustably positionable to lock relative to the remainder of its respective cleat between a plurality of predetermined heights. In aspect, the predetermined heights correspond to locking positions.

11 Claims, 6 Drawing Sheets

U.S. PATENT DOCUMENTS

| | | | | | |
|---|---|---|---|---|---|
| 4,523,396 | A | | 6/1985 | Dassler | |
| 4,633,600 | A | | 1/1987 | Dassler et al. | |
| 5,123,184 | A | | 6/1992 | Ferreira | |
| 5,289,647 | A | * | 3/1994 | Mercer | 36/134 |
| 5,321,901 | A | | 6/1994 | Kelly | |
| 5,361,518 | A | | 11/1994 | Sussmann et al. | |
| 5,628,129 | A | * | 5/1997 | Kilgore et al. | 36/134 |
| 5,638,615 | A | | 6/1997 | Korsen | |
| 5,848,482 | A | | 12/1998 | Bathum | |
| 5,960,568 | A | | 10/1999 | Bell et al. | |
| 6,108,944 | A | | 8/2000 | Savoie | |
| 6,154,984 | A | | 12/2000 | Adam | |
| 6,389,714 | B1 | * | 5/2002 | Mack | 36/61 |
| 6,647,647 | B2 | * | 11/2003 | Auger et al. | 36/134 |
| 2003/0093925 | A1 | * | 5/2003 | Auger et al. | 36/134 |

FOREIGN PATENT DOCUMENTS

| | | | |
|---|---|---|---|
| EP | 0783845 | | 7/1997 |
| EP | 0815759 | | 1/1998 |
| FR | 2567004 | | 7/1984 |
| FR | 2567004 | A1 * | 1/1986 |
| GB | 456979 | | 11/1936 |
| GB | 2341308 | | 3/2000 |
| WO | WO 0178544 | | 10/2001 |

* cited by examiner

ARTICLE OF FOOTWEAR WITH HEIGHT ADJUSTABLE CLEAT-MEMBER

FIELD OF THE INVENTION

The present invention relates to an article of footwear having one or more cleat members, in particular an athletic shoe having one or more selectively adjustable height cleat members.

BACKGROUND OF THE INVENTION

Consumers and athletes purchase footwear for use in athletic activities such as running, cross training, soccer, football, baseball, basketball, tennis, walking. The shoes can affect the performance and contribute to their overall success in an athlete event for the wearer. Cleated athletic shoes, and particularly soccer shoes, conventionally include a sole and an upper extending upwardly from the sole and into which the foot of the athlete is positioned and secured in place. In addition, cleats are secured to the sole and extend downwardly from the sole to provide the traction of the shoe when the athlete runs.

It is conventionally known to use particular types of ground-engaging members for certain types of playing surfaces. Most generally, the selection of a particular ground-engaging member requires balancing traction-increasing characteristics of the ground-engaging members versus other playing factors. For example, a player who needs to quickly or suddenly turn while running must be able to quickly pick up his or her feet from the playing surface. Otherwise, if the player "plants" a foot, his or her ankle or knee may be injuriously twisted when attempting to change direction suddenly. Therefore, the ground-engaging members used in this case should not increase traction too much in order to avoid injury. On the other hand, a player whose movement involves mostly running in one direction can benefit from a relatively greater increase in traction.

Changing conventional removable ground-engaging members is generally time-consuming and labor intensive, because a collection of individual ground-engaging members must be carried, and changing each ground-engaging member requires removing one ground-engaging member from a shoe in addition to mounting a new ground-engaging member. Furthermore, individual ground-engaging members may be dropped inadvertently, and, as a result, may be lost, particularly when changing ground-engaging members in a hurried manner.

Furthermore, conventional removable ground-engaging members must be adequately rotationally tightened so as to ensure good engagement between the shoe and the ground-engaging member. However, it is conventionally difficult to recognize when the ground-engaging member has been adequately tightened. Thus, the ground-engaging member may be inadvertently over-torqued in an attempt to ensure good engagement. This can damage the screw threads on the shoe and/or on the ground-engaging member, making it difficult or even impossible to subsequently disengage the ground-engaging member from the shoe when desired. On the other hand, the ground-engaging member may be inadvertently under-torqued (for example, to avoid damage caused by over-torquing). When this occurs, the ground-engaging member may not function as a stable traction device and/or may become loose and be susceptible to falling off of the shoe.

In view of the foregoing, it is desirable to provide the ground-engaging functionality of conventional ground-engaging members as discussed above, while avoiding problems associated with using individual elements that are selectively attached to a shoe sole.

SUMMARY OF THE INVENTION

The present invention is generally directed to an article of footwear having a selectively height adjustable cleat members provided on a sole.

In one aspect, an article of footwear may have a cleat member provided in a unit engaged with or otherwise attached to the sole. The cleat member may have a portion which extends outwardly from the sole that is positionable at one of a plurality of predetermined positions relative to the sole and includes a biasing function to at least one of the predetermined positions.

In another aspect of the invention, a cleat may include a coupling engaged with the sole and a tip that is selectively extendable and retractable via a linear movement and rotational movement relative to a remainder of a cleat so as to present a selectively variable height.

In another aspect of the invention, an article of footwear includes an upper and a sole attached to the upper. The sole may include a plurality of cleats in which the cleats include a gyre-linear cleat portion adjustably positionable to lock relative to the remainder of its respective cleat between a plurality of predetermined heights. In aspect, the predetermined heights correspond to locking positions.

In yet another aspect, a cleat member according to the present invention may include a tip locking system for selectively locking the tip in one or more height positions relative to a coupling.

BRIEF DESCRIPTION OF THE DRAWINGS

A more complete understanding of the present invention and the advantages thereof may be acquired by referring to the following description in consideration of the accompanying drawings, in which like reference numbers indicate like features, and wherein.

DETAILED DESCRIPTION OF THE PREFERRED EMBODIMENTS

FIGS. 1-10 illustrative features of an article of footwear, such as a cleated athletic shoe 10. Shoe 10 includes a upper 13 which may be connected to a footplate 12. For the purposes of the description herein, shoe 10 has a "sole" which includes footplate 12. However, other parts that may be included in a sole, such as a midsole, etc. have been omitted from the drawings for clarity.

Figure 1:
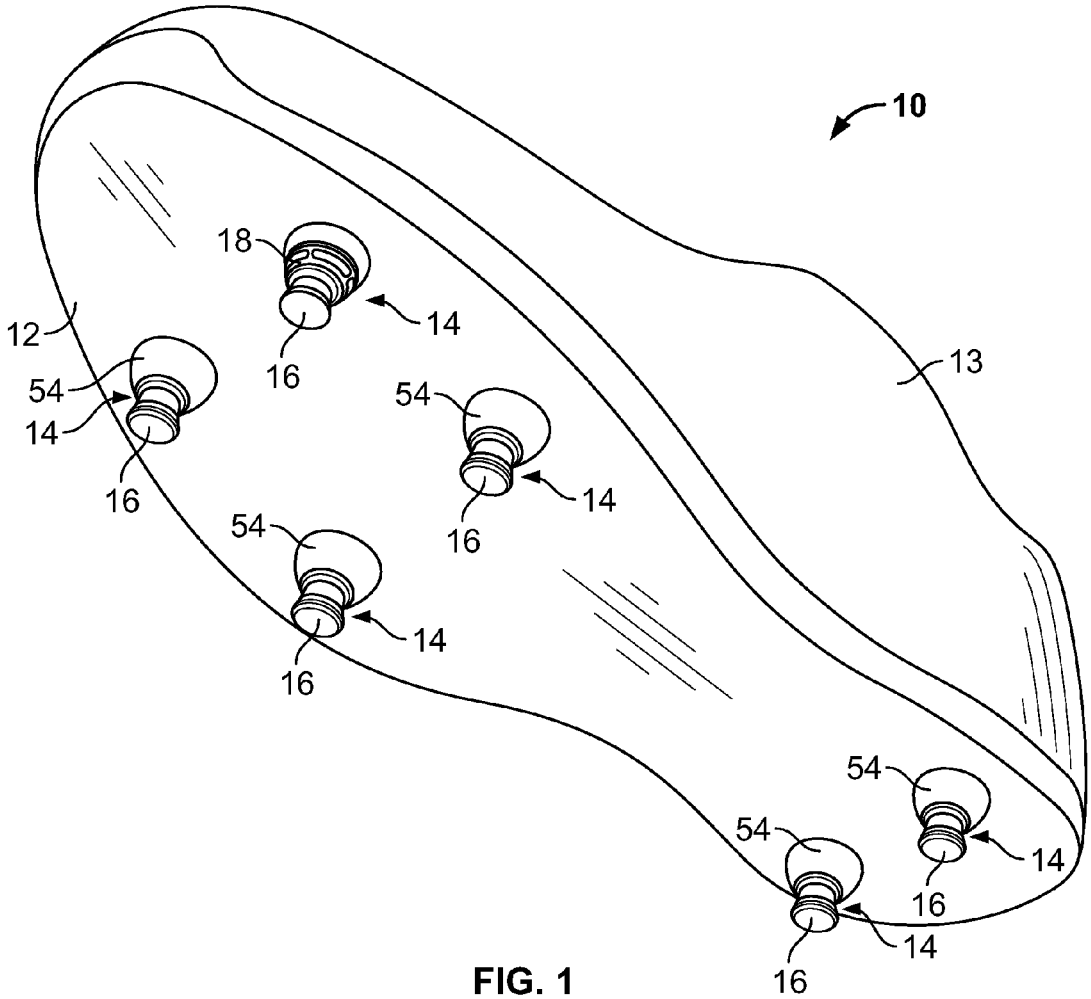
FIG. 1 is a bottom perspective view of an article of footwear provided with a plurality of cleat units according to the present invention.
Figure 2:
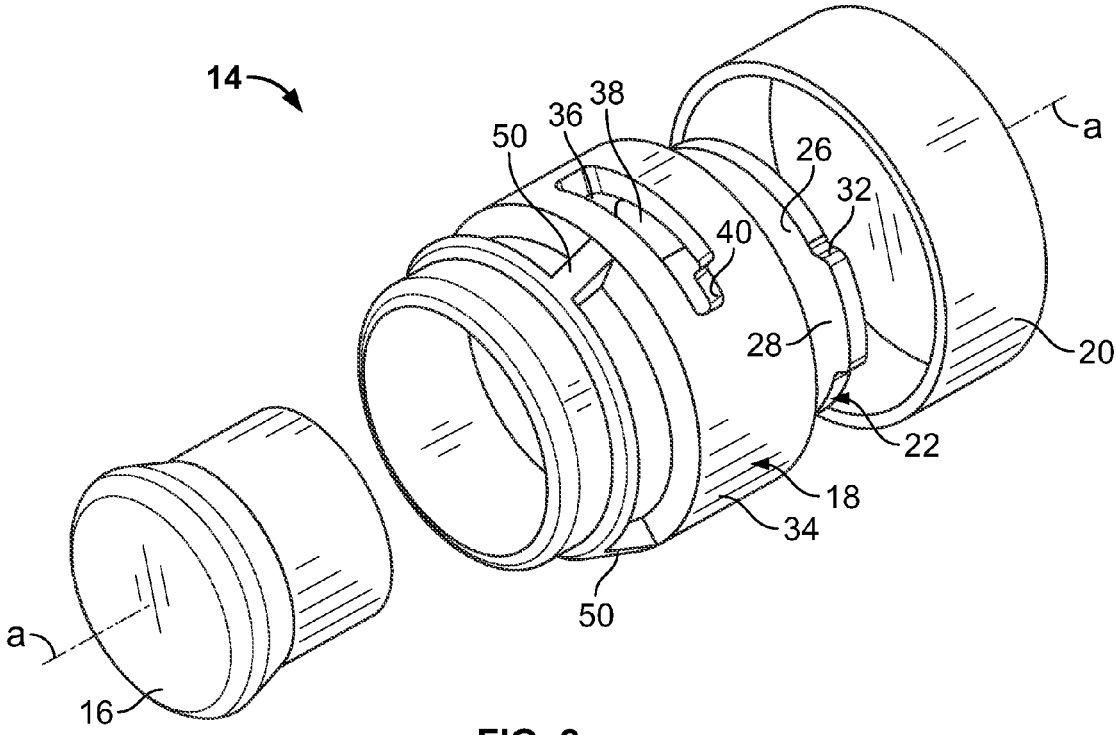
FIG. 2 is a first exploded assembly view of a cleat unit illustrating component parts according to the teachings of the present invention.
Figure 3:
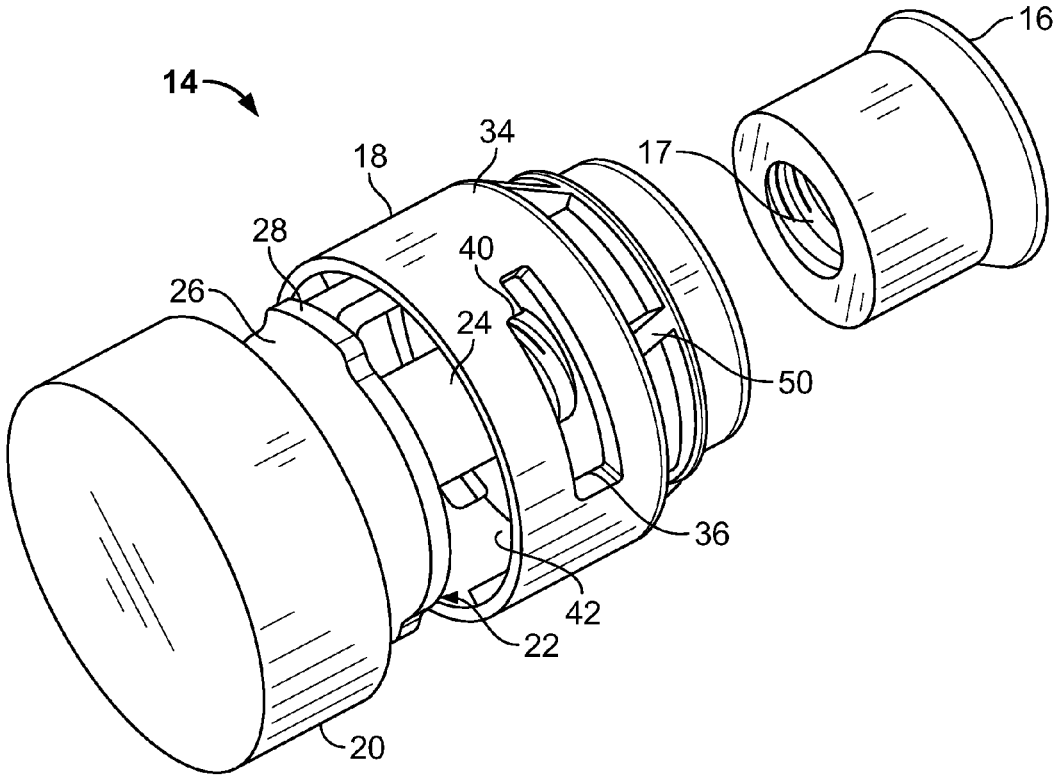
FIG. 3 is a second exploded assembly view of a cleat unit illustrating component parts according to the teachings of the present invention.
Figure 4:
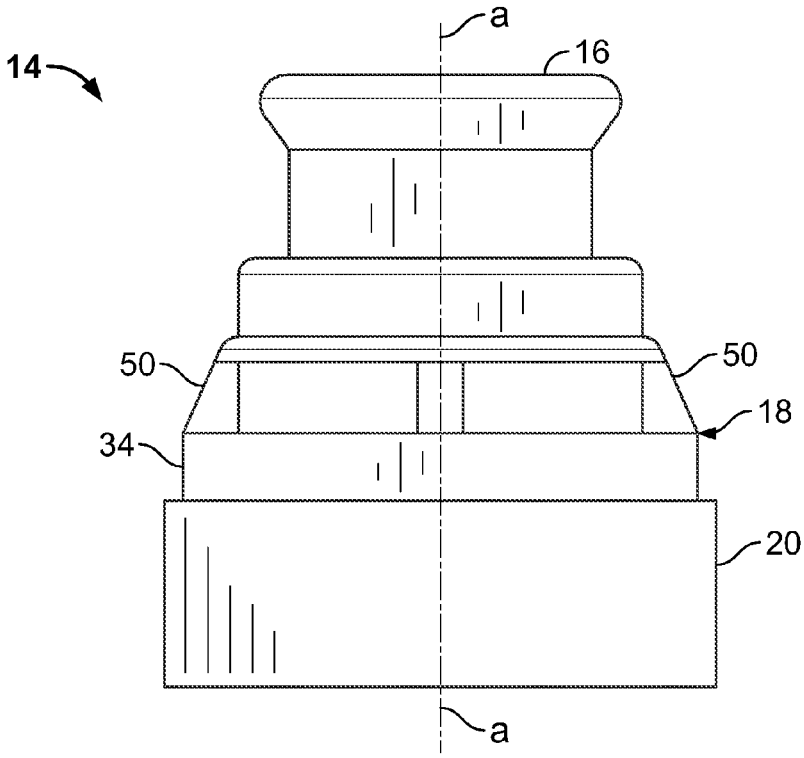
FIG. 4 is an assembled cleat unit according to the teachings of the present invention.
Figure 5:
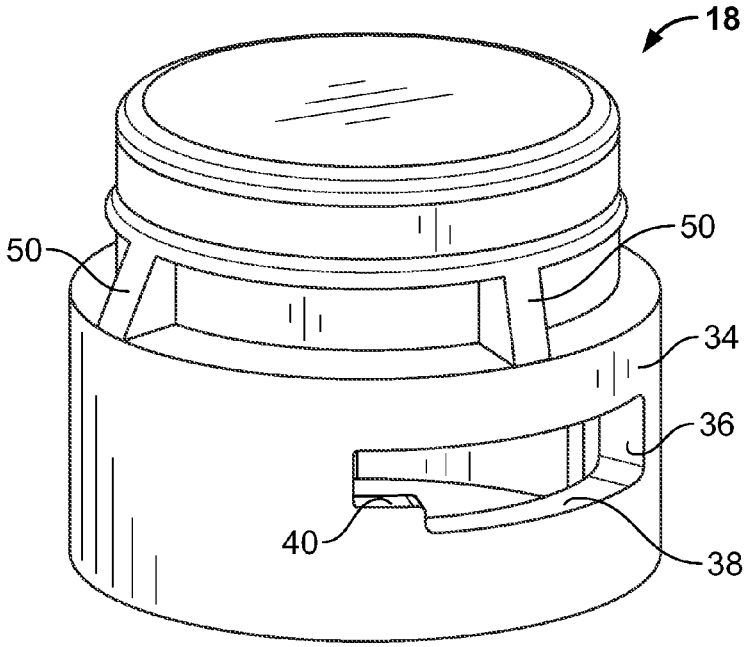
FIG. 5 is a perspective view of a coupling unit according to the teachings of the present invention.

Referring to FIG. 1, in the illustrated shoe 10, the footplate 12 may extend along the entire length of the sole. Footplate 12 functions to provide a ground engaging component of shoe 10 designed for traction and is typically made of a substantially abrasion resistance material. Footplate 12 can be formed by injection molding a plastic resin composite into a desired shape. If desired, the plastic resin composite may be an enhanced resin having a fibrous composition, such as nylon, glass, or graphite fiber. The arrangements provide a relatively stiff footplate for withstanding abrasion and wear from the movements of the foot against ground surfaces. Nevertheless, footplate 12 can be formed by other desirable materials and methods.

Footplate 12 includes at least one ground-engaging unit 14, such as a cleat unit extending from the base of the footplate 12. Footplate 12 includes a plurality of cleat units 14 distributed over the surface of footplate 12. FIG. 1 illustrates one example of how cleat units 14 may be distributed over the surface of footplate 12. However, it should be recognized that the specific number, location, and/or shape of the cleat units 14 that are provided on footplate 12 may vary widely and still be in accordance with the present invention as contemplated.

Referring to FIGS. 1-4, each cleat unit 14 may include a ground engaging tip 16 adjustably mounted relative to a coupling member 18. In such a configuration, tip 16 may be provided in a desirable shape such as conical, frusto-conical, pyramidal, substantially cylindrical or may be shaped for a given activity or sport. Coupling member 18 is preferably fixedly attached to the footplate 12. For example, the coupling 18 may be overmolded onto the footplate 12. Generally, tip 16 is positionably height coupled to coupling member 18 so that an extent to which tip 16 extends from coupling 18 can be varied for raising and lowering thereof. For example, tip 16 is gyre-linearly coupled in an extendable manner to coupling member 18. That is, tip 16 may have one of a plurality of fixed positions relative to coupling member 18, generally rotation on a central axis a-a and a linear movement along the axis a-a whereby tip 16 can be retained in a desired position. Other arrangements are possible. In one configuration, the tip may be adjusted within a range of 1.0 mm to 3.0 mm increments for ground penetration performance. Preferably, tip 16 is selectively locked in a given position, so that tip 16 does not move out of position under normal use conditions. In this manner, the traction performance of shoe 10 can be adjusted by varying the height of tip 16. Further, the cleat configuration is advantageous for sports such as soccer which may take place on soft ground conditions. For example, these soft ground conditions generally pertain to wet fields, soggy grass, or muddy grounds.

In one arrangement, tip 16 of the cleat unit 14 is mounted onto the distal end of a plunger unit 22. The plunger unit 22 is resiliently biased within a coupling member 18 so that the cleat tip 16 is movable in a plurality of height positions relative to the footplate 12. The plunger 22 comprises a linear shaft 24 which retains the cleat tip 16. Tip 16 has a threaded bore 17 (see, for example, FIGS. 3, 7 and 8) formed therein for receiving the distal end 23 of shaft 24 of the plunger unit 22. In this arrangement, the shaft distal end may include complementary threads for receiving the bore 17. In one arrangement, a plunger flange 26 is located on the proximal end of the shaft opposed to the cleat tip 16 (see FIG. 6).

Figure 6:
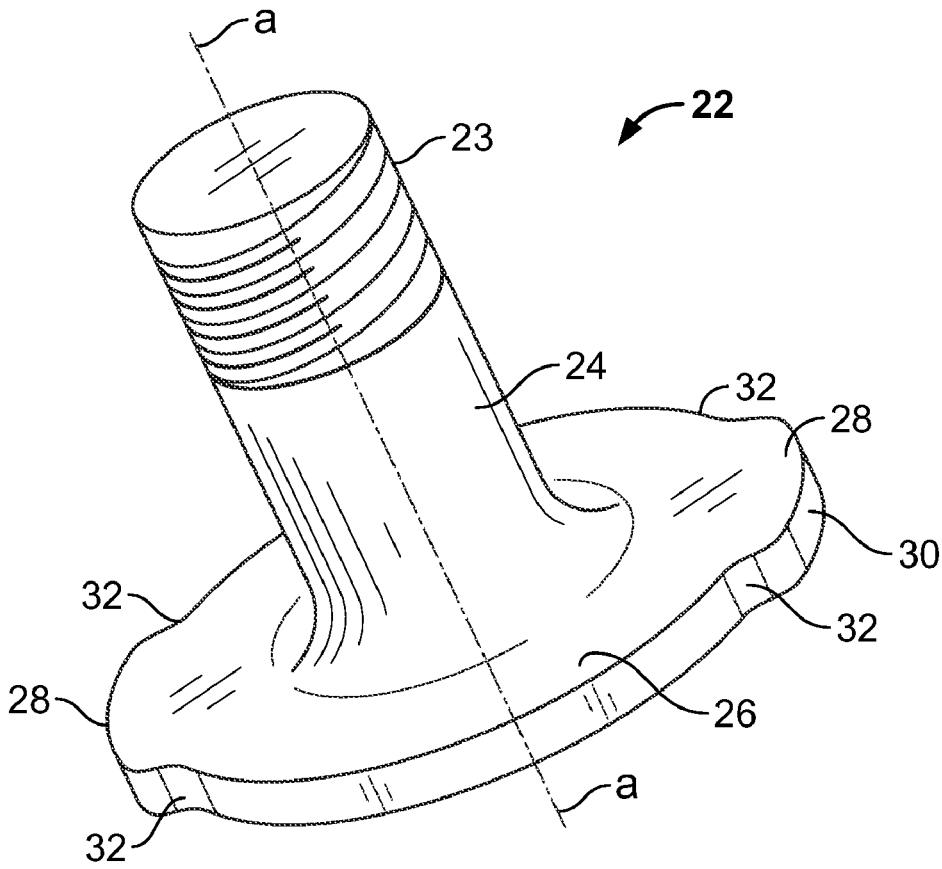
FIG. 6 is a perspective view of a plunger unit according to the teachings of the present invention.

It is desirable to provide a locking system so that the cleat tip 16 can be maintained in a desired position relative to the coupling member 18 during ground-engaging use. In one component of a locking system, is shown in FIG. 6. For locking performance and stability, the plunger 22 includes opposed locking tabs 28 extending outwardly from the flange 26. The locking tabs 28 have a distal edge 30 and notch portions 32 which extends towards the shaft 24 of the plunger unit 22.

Figure 10:
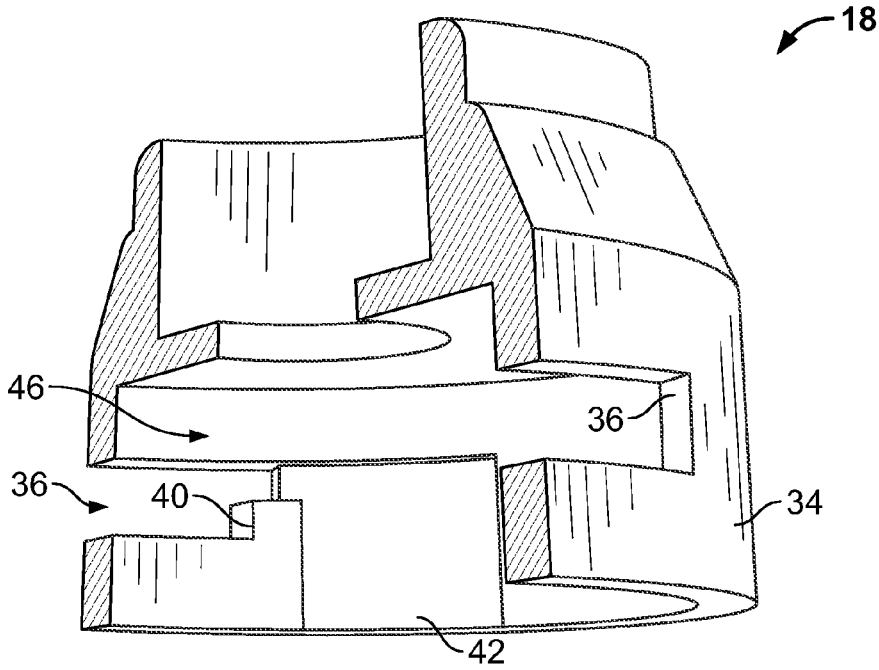
FIG. 10 is a fragmentary perspective view of the coupling unit of FIG. 5 with a portion of the wall removed to reveal interior surfaces.

Referring to FIGS. 1-5, coupling member 18 retains the cleat tip 16 and the plunger unit 22. The coupling member 18 comprises a circumferential wall 34 having opposed slots 36 for receiving therein the locking tabs 28 of the plunger 26. The slots 36 have a receiving portion 38 and a locking portion 40 to prevent rotational movement of the plunger 22 under normal ground engaging use of the shoe 10. As best seen in FIG. 10, the interior surface of the wall 34 includes a channel recess 42 in which the locking tabs 28 of plunger 22 can travel therein. In one arrangement, the diameter of the distal edge 30 of the locking tabs 28 is shorted than the channel recess 42 diameter so that the tabs 28 can freely move within the recess 42. The channel recess 42 has a recessed depth into the wall member thickness. The slots 36 are disposed adjacent to the channel recess 42 so that the depth is opened to the slot.

Figure 8:
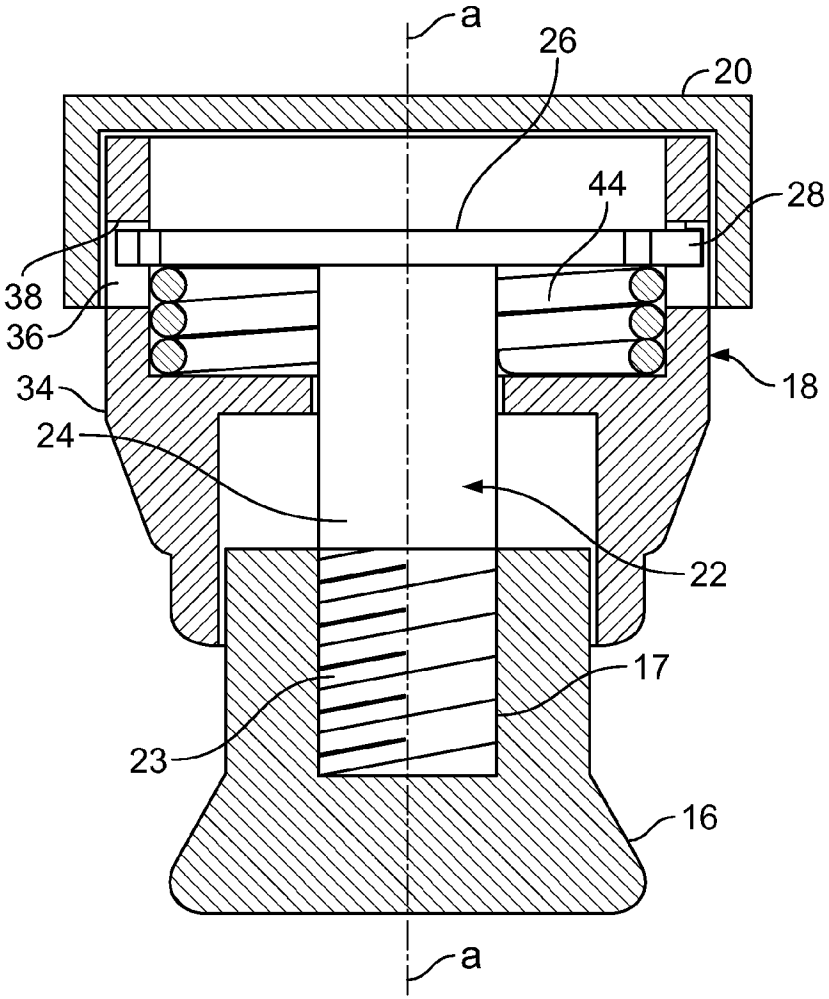
FIG. 8 is a second section view of the cleat unit illustrating interior components therein and another position of use.
Figure 7:
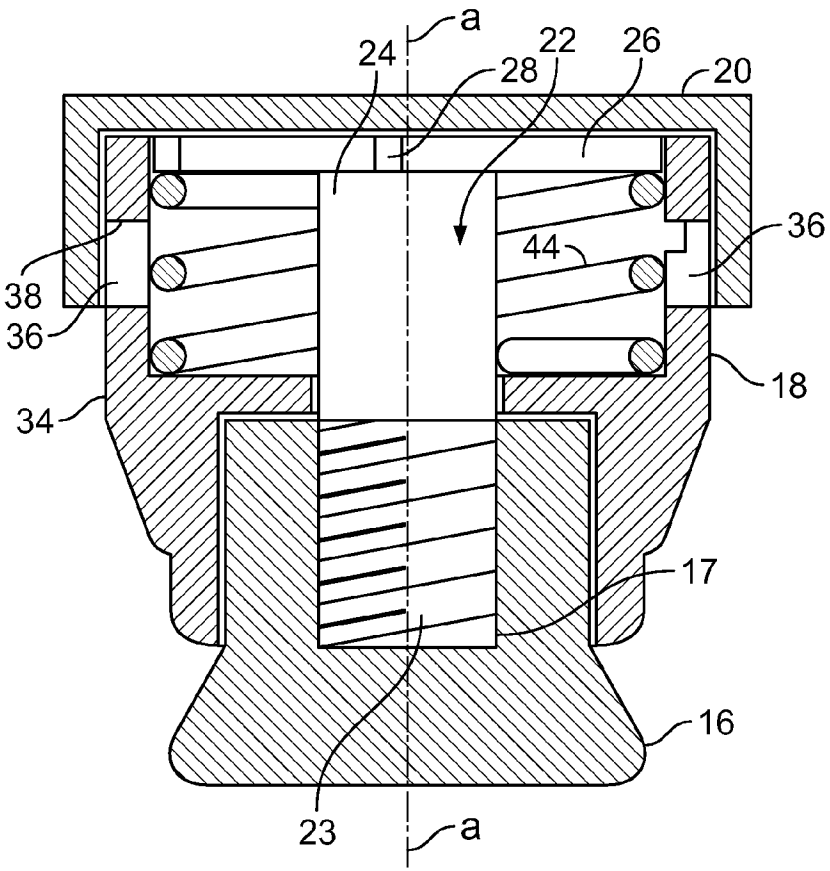
FIG. 7 is a first section view of the cleat unit illustrating interior components therein and one position of use.

Referring to FIGS. 7 and 8, a biasing member 44 is provided around the shaft 24 for resiliently biasing the cleat tip 16 towards the footplate 12 via the plunger 22. The biasing member 44 may be provided in the form of a coil spring.

With continued reference to FIGS. 7 and 8, in one operation, if a user desires to move the tip 16 from a lower position to a higher position for deeper ground penetration, the user may pull upward on the cleat tip 16. This upward action moves the locking tabs 28 a corresponding linear movement in the channel recess 42. Once, the locking tabs reach the height of the slots 36, the notches of the locking tab 28 are freely movable for rotation into the slot 36. In one arrangement the rotation can be counter-clockwise. Another arrangement the rotation can be clockwise. Thus, to "lock" the cleat tip 16 in place, the user twists the cleat tip so as to align locking tabs 28 of the flange 26 into slots 36 of the coupling 18. Also during the upward action of plunger 22, the spring 44 squeezes or other compresses against the flange 26 of the plunger 22 and a top portion of a coupling cavity 46 (See FIGS. 7, 8 and 10). Thus, a spring biasing force is created with the upward action.

For lowering the cleat tip 16, the user may pull upward on the tip to overcome the biasing force of the spring 44. The locking tabs 28 are enabled to travel over the locking portion 40 of the slot 36 to the channel recess 42. The user may then rotate the tip 16 or plunger 22 clockwise to move the locking tabs 28 into the channel recess 42. The tip 16 may be released by the user so that the spring biasing force moves or pushes the flange 26 of the plunger 22 towards to sole 12. A spring biasing force also causes a friction fit in the surface of the receiving portion 38 of the slot 36 for additional locking engagement. In this way, the height of the tip 16 and the ground-engaging performance of the shoe 10 can be quickly adjusted by a user without tools.

Tip 16, plunger unit 22 and coupling member 18 may be made from an appropriate material exhibiting sufficient resistance to material fatigue. In one example, the aforementioned elements of cleat unit 14 may be made from molded glass-filled nylon, or a plastic. Alternatively, at least tip 16 may be formed from a desirable metal. The flange 26 of plunger unit 22 forms a wide base for load transfer or weight bearing performance. In this configuration, the locking tabs 28 have an extended length into the slots 36 of the coupling member 18. The length of tabs facilitates load transfer to the coupling member 18 while maintaining a locked arrangement.

Figure 9:
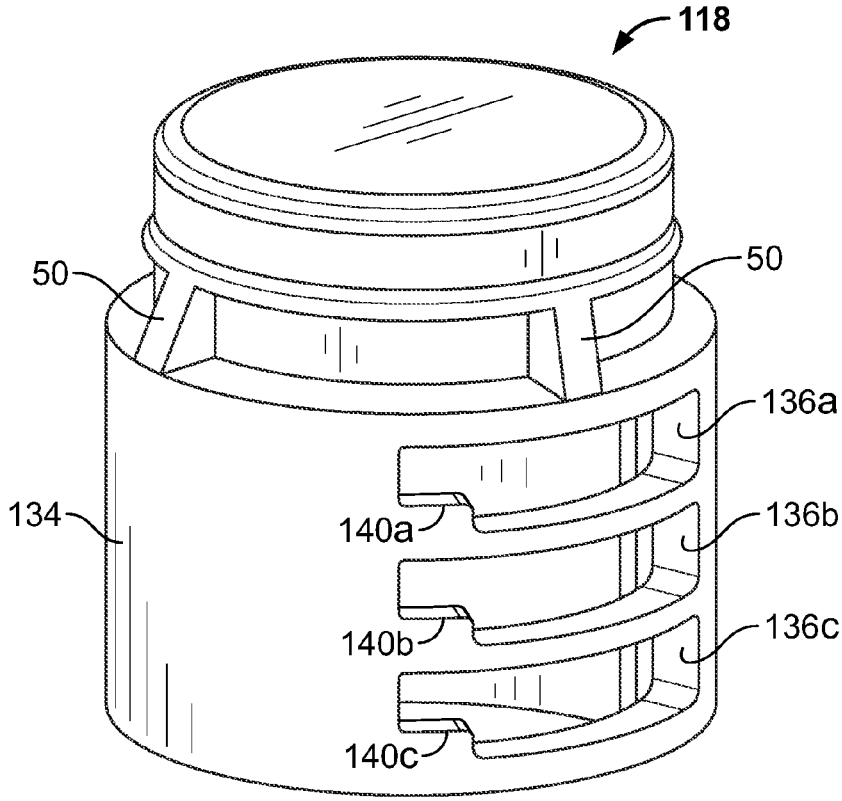
FIG. 9 is a perspective view of an alternative coupling unit according to the teachings of the present invention.

FIG. 9 illustrates an alternative embodiment of a coupling member 118 which may be used with shoe 10. Coupling 118 has a similar construction as coupling member 18, except generally for the slot-channel recess configuration. Coupling member 118 includes a plurality of slots 136*a-c* and corresponding locking portions 140*a-c* in wall 134 for multiple vertical locked positions of the tip 16 (see FIG. 1). In this embodiment, the opposing predetermined slots 136*a-c* enable the cleat unit to have four positions for traction performance. The opposing slots 136*a-c* are generally coplanar in that the locking tabs of the plunger unit reliably engage. To adjust from a deep penetration configuration to a less deep traction configuration, a user can move the tip from slot 136*a* to 136*c*, by allowing the biasing force of the spring to pull the plunger towards the surface of the footplate. Nevertheless, the coupling member 118 in combination with plunger enables quick adjustment of the tip heights. In one configuration, the tip may be adjusted within a range of 1.0 mm to 3.0 mm increments for ground penetration performance.

Generally, coupling 18 is molded into footplate 10. A base cap 20 is provided so that the material of the foot plate does not fill into the slots 36. The base cap 20 may fit around the coupling member 18 on a snug-fit arrangement for improved manufacturing. The material comprising footplate 12 may be overmolded at least adjacent to a distal edge of wall member 34. In this regard, an exterior surface of wall member 34 may optionally be provided with ribs or splines 50 to provide an increased bonding area, keep the cross-sectional shape substantially circular during molding, and/or prevent coupling 18 from rotating within a raised portion of footplate 12 during play and/or adjustment. In one example of the present invention as shown in FIG. 1, the material comprising the footplate 12 may be over molded over the exterior surface of wall member to form raised portions 52 extending outwardly from the surface of footplate 12, so that substantially a portion of tip 16 and coupling member 18 protrudes outwardly therefrom. For example, 2.5 mm of the coupling member 18 may be exposed.

According to an alternative embodiment, as shown in FIG. 1, the cleat characteristics of shoe 10 can be selectively altered by adjusting the respective heights of cleat units 14 provided on the sole of a shoe. The heights of the cleat units 14 can be all changed to the same height. Also, the heights of the cleat units 14 can be all changed to different respective heights. Finally, some heights can be made the same while others are set to different heights. For example, a user can adjust the two toe cleat units for a deeper ground penetration and toe off performance, while maintaining shallower position of the rearfoot cleat units. To change the height of a given cleat unit 14, tip 16 is, for example, is linear movable to change its height relative to the remainder of the shoe sole and twisted to lock in place. In this way, the ground engaging characteristics of the article of footwear can be adjusted by providing a given arrangement of cleat units 14 of varying or the same heights. This permits greater control over the ground penetration performance of the article of footwear.

If desired, a sealing member, such as an O-ring seal, may be provided in the annular space between shaft 24 and coupling cavity 46, for example, a radially inner portion of O-ring seal contacts the peripheral surface of the shaft. O-ring seal prevents dirt and debris from lodging into the coupling cavity 46. In addition, as tip 16 is moved upwardly and downwardly from coupling member 18, O-ring seal provides a wiping action against the peripheral surface of the shaft. O-ring seal may be made of any known, soft and resiliently pliable material, such as, soft plastic or rubber.

Upper 13 is generally attached around its bottom periphery to sole 12 by a desirable conventional method such as, stitching or adhesive bonding. Upper 12 of shoe 10 can be made of any desirable material or a combination of materials such as, split-leather, full-grain leather, suede, polyester, nylon, or a breathable mesh. If desired, the shoe 10 may include an insole or a sockliner (not shown) disposed therein and is preferably positioned between the foot of the wearer and the sole 12. The sockliner provides additional cushioning and shock absorption of the shoe 10. If desired, sockliner may be removable and replaceable from shoe 10. If desired, shoe 10 may include a midsole for providing cushioning and support. Optionally, a heel cup may be provided to firmly support the heel of the foot of the wearer.

In operation, the previously described features, individually and/or in any combination, improves stability and traction control of which are important in sports needing cleated footwear. Further, the features of the shoe 10 may reduce injury to a user. While the various features of shoe 10 operate work together to achieve the advantages previously described, it is recognized that individual features and subcombinations of these features can be used to obtain some of the aforementioned advantages without the necessity to adopt all of these features.

Although the invention has been defined using the appended claims, these claims are exemplary in that the invention may be intended to include the elements and steps described herein in any combination or sub combination. Accordingly, there are any number of alternative combinations for defining the invention, which incorporate one or more elements from the specification, including the description, claims, and drawings, in various combinations or sub combinations. It will be apparent to those skilled in the relevant technology, in light of the present specification, that alternate combinations of aspects of the invention, either alone or in combination with one or more elements or steps defined herein, may be utilized as modifications or alterations of the invention or as part of the invention. It may be intended that the written description of the invention contained herein covers all such modifications and alterations.

What is claimed is:

1. An article of footwear comprising:

an upper and a sole attached to the upper, the sole including a ground engaging member extending from the sole, the ground engaging member having a tip portion being positionable at one of a plurality of predetermined heights relative to the sole, the tip portion being configured for resiliently biasing towards the sole for movement between the predetermined heights, further comprising a slot in the coupling for locking the tip portion relative to the coupling; wherein the tip portion is connected to a plunger unit which locks into the slot; in which the plunger unit includes at least one locking tab extending therefrom and the coupling includes a recessed pathway on an interior surface and the locking tab being movable in the recessed pathway to engage the slot.

2. The article of footwear according to claim 1, wherein said ground engaging member comprises: a coupling attached to the sole; and the tip portion includes a tip movable to the coupling for being selectively extendable and retractable relative to the coupling.

3. The article of footwear according to claim 1, in which the locking tab is rotatable into the slot from the recessed pathway.

4. The article of footwear according to claim 1, in which the slot includes a locking portion to prevent movement of the locking tab once engaged in a locked position.

5. The article of footwear according to claim 1, further comprising a coupling including a circumference locking slot corresponding to at least one of the predetermined heights.

6. An article of footwear comprising:

an upper and a sole attached to the upper, the sole including a ground engaging member extending from the sole, the ground engaging member having a tip portion being positionable at one of a plurality of predetermined heights relative to the sole, the tip portion being configured for resiliently biasing towards the sole for movement between the predetermined heights; further comprising a coupling including a circumference locking slot corresponding to at least one of the predetermined heights in which the tip portion is connected to a resiliently biased plunger unit configured to engage the locking slot; in which the plunger unit includes a shaft and a tab, the tab extending from the shaft for being received into the locking slot.

7. A cleated article of footwear comprising:

an upper and a sole attached to the upper; the sole including a plurality of cleats, each said cleat including a gyre-linear cleat and a replaceable tip;

wherein the gyre-liner cleat portion is adjustably positionable to lock relative to the remainder of its respective cleat between a plurality of predetermined heights; and wherein the replaceable tip is resiliently biased towards the sole.

8. The article of footwear according to claim 7, in which the cleat portion includes a locking portion constructed and arranged to engage the remainder of the cleat to maintain the cleat portion in a fixed position relative to the sole.

9. The article of footwear according to claim 7, in which the cleat portion includes a linear spring member for biasing the replaceable tip toward a low height position.

10. The article of footwear according to claim 9, in which the remainder of the cleat includes a plurality of circumferentially extending slots constructed and arranged to engage the cleat portion in a seated position via the spring member.

11. The article of footwear according to claim 10, in which the remainder of the cleat includes an interior surface with an opened pathway to the slots so as to receive a locking tab of the cleat portion.

* * * * *